US008578923B2

(12) United States Patent
Ghelfi

(10) Patent No.: US 8,578,923 B2
(45) Date of Patent: Nov. 12, 2013

(54) BASE FOR SUPPORTING TILES TO BE CUT, A KIT AND A METHOD FOR ADAPTING A MANUAL TILE-CUTTING MACHINE

(75) Inventor: Stefano Ghelfi, Bologna (IT)

(73) Assignee: Ghelfi S.r.l., Bologna (IT)

( * ) Notice: Subject to any disclaimer, the term of this patent is extended or adjusted under 35 U.S.C. 154(b) by 400 days.

(21) Appl. No.: 13/027,565

(22) Filed: Feb. 15, 2011

(65) Prior Publication Data

US 2011/0197870 A1 Aug. 18, 2011

(30) Foreign Application Priority Data

Feb. 16, 2010 (IT) ..... BO2010A0081

(51) Int. Cl.
*B26D 3/08* (2006.01)

(52) U.S. Cl.
USPC ..... 125/23.02; 125/23.01; 125/35; 225/96

(58) Field of Classification Search
USPC ..... 451/65, 66, 69, 70, 415; 83/886, 49; 225/96; 29/401.1; 125/65, 66, 69, 70, 125/415, 23.02, 23.01, 35, 13.01
See application file for complete search history.

(56) References Cited

U.S. PATENT DOCUMENTS

| | | | | |
|---|---|---|---|---|
| 5,480,081 | A * | 1/1996 | Wilson et al. | 225/96.5 |
| 5,482,026 | A * | 1/1996 | Russell | 125/12 |
| 5,545,079 | A * | 8/1996 | Larsson et al. | 451/342 |
| 6,047,871 | A * | 4/2000 | Chen | 225/96.5 |
| 6,080,041 | A * | 6/2000 | Greenland | 451/11 |
| 6,164,272 | A * | 12/2000 | Fouy | 125/12 |
| 6,953,036 | B2 * | 10/2005 | Ishii | 125/23.02 |
| 7,140,361 | B1 | 11/2006 | Chao-Huan | |
| 7,748,372 | B2 * | 7/2010 | Harding et al. | 125/23.02 |
| 7,823,575 | B2 * | 11/2010 | O'Banion et al. | 125/23.02 |
| 8,006,683 | B2 * | 8/2011 | Scherer et al. | 125/23.01 |
| 2002/0124841 | A1 * | 9/2002 | O'Banion et al. | 125/13.01 |
| 2009/0145416 | A1 * | 6/2009 | Harding et al. | 125/23.02 |

FOREIGN PATENT DOCUMENTS

| | | |
|---|---|---|
| FR | 1580300 A | 9/1969 |
| GB | 2378414 A | 2/2003 |

OTHER PUBLICATIONS

International Search Report for corresponding EP patent application No. 11154308, Completed May 18, 2011, 2 pages.

* cited by examiner

*Primary Examiner* — George Nguyen
(74) *Attorney, Agent, or Firm* — William J. Sapone; Ware Fressola Maguire & Barber LLP

(57) ABSTRACT

The invention relates to a base (2) for restingly receiving tiles to be cut, comprising: a surface (13) for restingly receiving a tile; and a blade (4) for encountering a lower surface of the tile during a stage of scoring the tile. The rest surface (13) is provided with a depression or slit (12) of such dimensions as to contain a portion of a rotary cutting disc (14) of the tile when the tile is resting on the rest surface (13). The invention also relates to a tile-cutting machine (1), comprising the base (2). The invention further relates to a kit and a method for adapting a manual tile-cutting machine to use with a group comprising a rotary cutting disc (14).

15 Claims, 3 Drawing Sheets

BASE FOR SUPPORTING TILES TO BE CUT, A KIT AND A METHOD FOR ADAPTING A MANUAL TILE-CUTTING MACHINE

FIELD OF THE INVENTION

The present invention relates to the technical sector of tile-cutting for tiles used in the construction industry.

In particular, the invention relates to a base for supporting tiles to be cut, as well as to a kit and a method for adapting a manual tile-cutting machine to use with a group comprising a rotary disc for cutting tiles.

The applications in which cutting tiles becomes necessary are for example tile-laying for covering a flooring; after laying, the residual portions of surface to be covered are usually less than the sizes of the tiles in use, which requires an adaptation of the tiles by a cutting to measure thereof.

The cutting operations of the tiles for their subsequent laying are usually performed by a manual tile-cutting machine or a circular saw.

DESCRIPTION OF THE BACKGROUND ART

A manual tile-cutting machine of known type enables a cut to be made along the upper surface of the tile to be cut, followed by a breaking thereof along the score line by directing a blow onto the tile. In this case the cut is obtained by an score followed by a snapping of the tile.

The manual tile-cutting machine comprises: a polygonal base comprising in turn a pair of plates arranged side-by-side to restingly receive a tile to be cut, and a blade arranged between the plates to abut the lower surface of the tile during the step of scoring the tile, guide means arranged above the base, for example constituted by a guide rail supported by two heads fixed to the base; and a specially-shaped lever able to slide on the guide means, which lever bears a wheel for scoring the tile and small breaker feet for snapping the tile.

The support plates are extractable and elastically constrained to the base.

The lever has on one side thereof a handle for facilitating its movement along the guide means and on the other side bears the breaker feet and the scoring wheel which is aligned to the underlying blade for the purposes of the scoring operations; the lever can further rotate with respect to an axis that is transversal to the guide means, such as to enable the scoring wheel to abut against the tile, as well as the scoring of the tile along the score line and the breaking of the tile by the feet.

As is known, tiles of a certain hardness cannot be cut (i.e. cannot be scored and then snapped, see above) easily: for some types of tile, the scoring and snapping are not possible, or the snapping is done incorrectly, for example along a different line to the score line and in a way that is unpredictable and renders the tile unusable.

In like cases circular saws are used, which comprise an electric motor that draws a diamond cutting wheel in rotation; additionally, the circular saw can be provided with a source of a depression, activated by means of an external supply source or via the actual electric motor of the saw, for aspirating the dust produced during cutting of the tile by the diamond cutting disc.

Manual tile-cutting machines are not therefore suitable for all types of tiles, though they do enable tiles to be cut much more rapidly than with circular saws; the latter are relatively less productive and produce more dust, though they do enable cutting tiles of all types.

Consequently, in order to cut tiles of any type and to maximize productivity both a manual tile-cutting machine and a circular saw are required, which constitutes a disadvantage in terms of occupied space during transport and in the work-site.

BRIEF DESCRIPTION OF THE INVENTION

The aim of the present invention consists in obviating the above-cited drawbacks.

This aim is attained with a base for supporting tiles to be cut comprising: a surface for restingly receiving a tile; a blade for encountering a lower surface of the tile during a stage of scoring the tile; characterized in that the rest surface is provided with a depression or slit of such dimensions as to contain a portion of a rotary cutting disc of the tile when the tile is resting on the rest surface.

With only a single support base it is possible to perform tile-scoring operations and a subsequent breakage thereof, as well as cutting operations with a group comprising a rotary cutting disc of a tile; thanks to the presence of the depression or slit which enables portion of the rotary cutting disc to be received for the purpose of the tile-cutting operations when the tile is resting on the rest surface of the base.

In this way overall dimensions can be contained without harming productivity, given that the base of the invention enables adaptation of convention cutting techniques both using the known manual tile-cutting machine (scoring and breaking) and using the known circular saw.

In a preferred embodiment, it is possible to adapt the base of a manual tile-cutting machine by making a depression or slit in the rest surface of the extractable rest plate; alternatively it is possible to replace the extractable plate of known type with an extractable plate provided with the depression or slit.

The above-mentioned aim is also attained with use of a kit for adapting a manual tile-cutting machine to use with a group comprising a rotary cutting disc for tiles.

Further, the above-described aim is attained with a method for adapting a manual tile-cutting machine to use with a group comprising a rotary tile-cutting disc.

It is thus advantageously possible to adapt pre-existing manual tile-cutting machines without there being any need to replace them, with the aim of obviating the drawback as mentioned in the preamble to the present description of the state of the art.

BRIEF DESCRIPTION OF THE DRAWINGS

Specific embodiments of the invention, and advantageous technical-functional characteristics correlated to the embodiment only partly derivable from the above description, will be made clear in the following description, in accordance with what is set out in the claims and with the aid of the accompanying figures of the drawings, in which:

Figure 1:
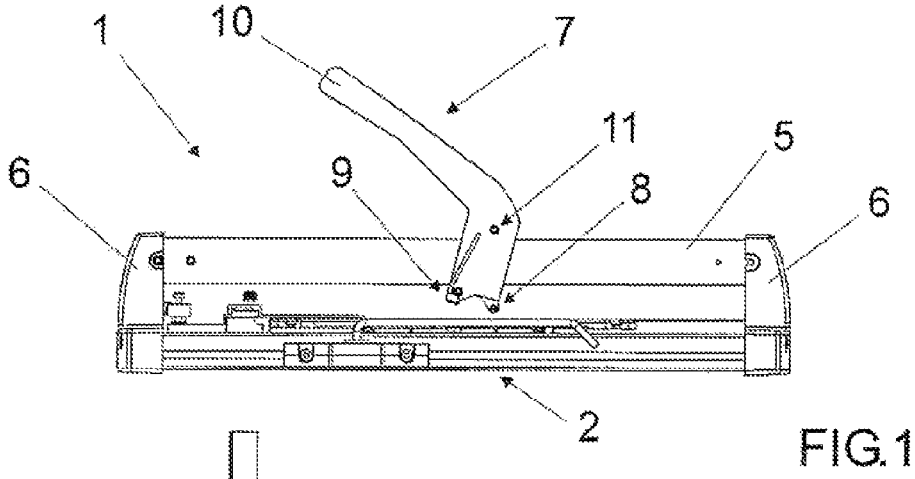
FIGS. 1, 2, 3 respectively illustrate a lateral view, a plan view and a perspective view of a tile-cutting machine of the invention, in an operating configuration in which a scoring wheel is used.

The tile-cutting machine illustrated in FIGS. 1-7 has been denoted by reference numeral 1 and is an example of a manual tile-cutting machine of conventional type, adapted for use with a group comprising a rotary cutting disc, as will fully emerge from the following.

DESCRIPTION OF THE PREFERRED EMBODIMENTS

Figure 2:
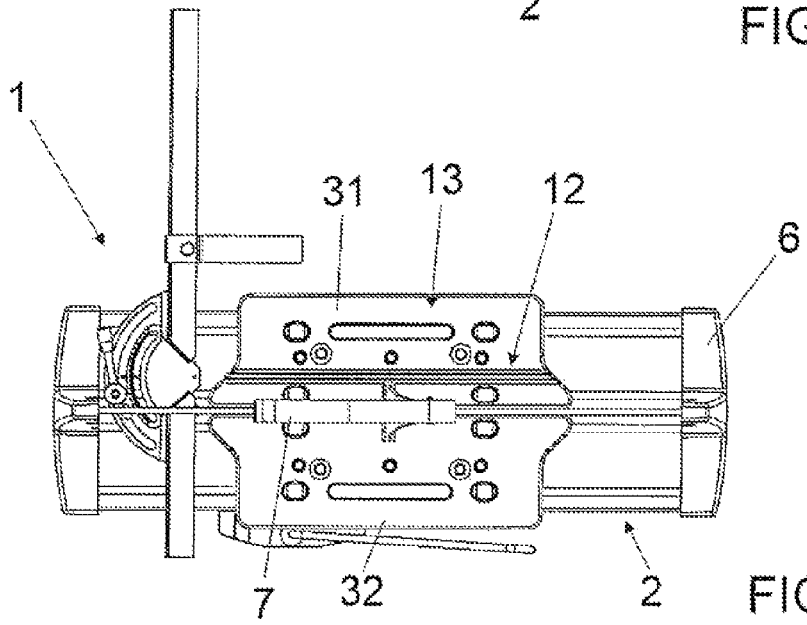
Figure 3:
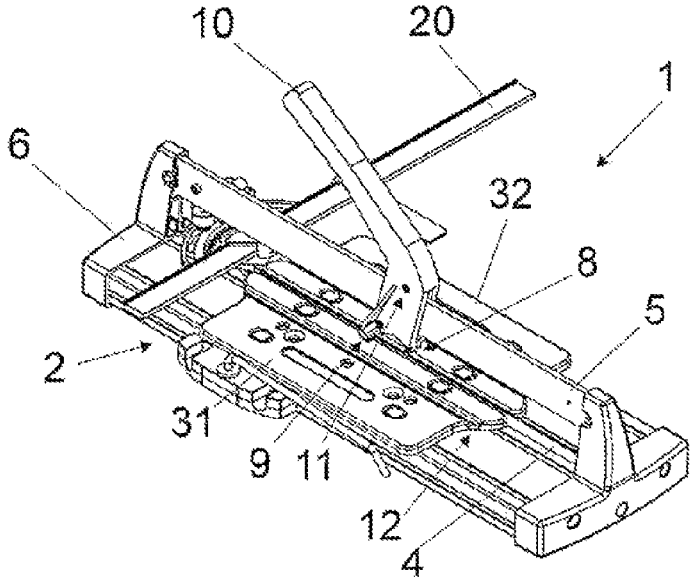
Figure 4:
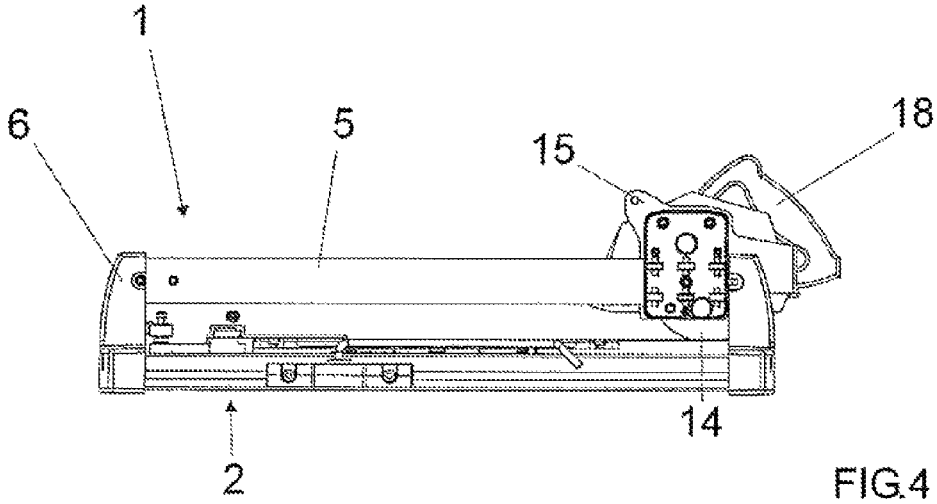
FIGS. 4, 5, 6, 7 respectively illustrate a lateral view, a plan view, a rear view in enlarged scale and a perspective view of a tile-cutting machine of the invention, in an operating configuration in which a group comprising a rotary cutting disc is used.
Figure 5:
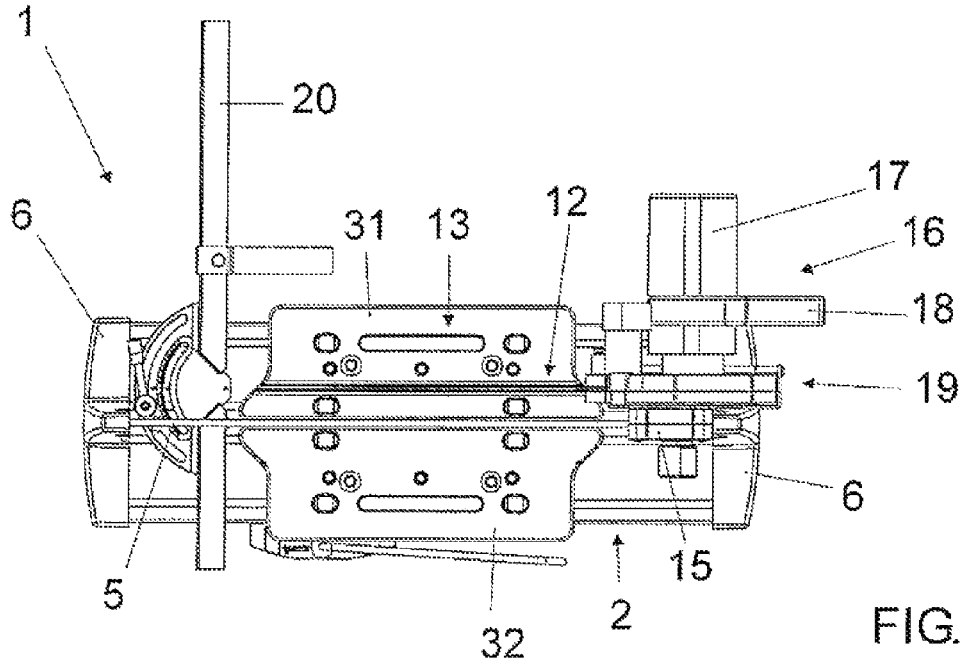
Figure 7:
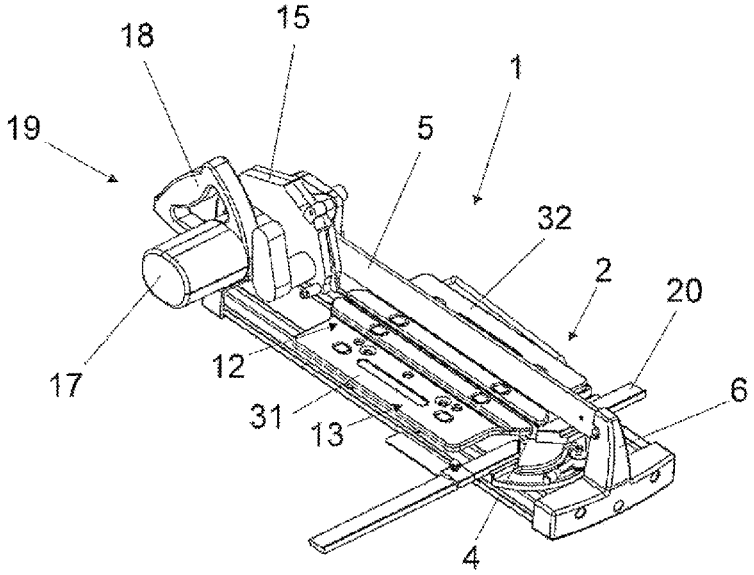
Figure 6:
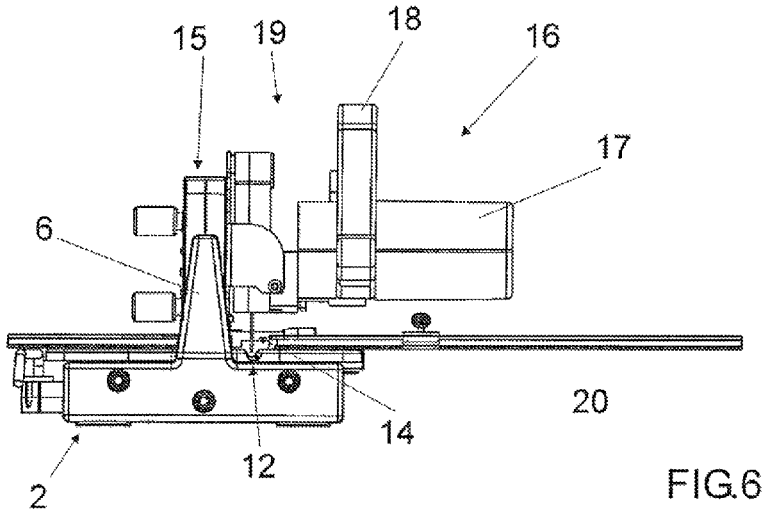

With reference to FIGS. 1-3, the tile-cutting machine 1 comprises: a polygonal base 2 comprising in turn a pair of plates 31, 32 arranged side-by-side such as to restingly receive a tile to be cut (not illustrated) and a blade 4 arranged between the plates 31, 32 for encountering the lower surface of the tile during the step of scoring the tile; guide means 5 arranged above the base 2, supported by two heads 6 fixed to the base 2; and a specially-shaped lever 7, of known type, able to slide on the guide means 5, which lever 7 bears a scoring element 8 of the tile and breaker feet 9 of the tile.

The rest plates 31, 32 are extractable and elastically constrained to the base 2; further, the extractable support plates 31, 32 exhibit an upper rest surface 13 for receiving a tile to be cut.

The lever 7 is removable and exhibits, on a side thereof, a handle 10 for facilitating displacement thereof along the guide means 5 and bearing, on another side thereof, the breaker feet 9 and the scoring element 8 which is aligned to the underlying blade 4 for the purposes of the scoring operations; the lever 7 can further rotate with respect to a transversal axis 11 to the guide means 5, such as to enable the scoring element 8 to abut against the tile, scoring the tile along the scoring line and breaking the tile using the feet 9.

The above-cited characteristics are those of a conventional manual tile-cutting machine.

The tile-cutting machine 1 of the present invention is distinguished by the fact that the rest surface 13 of one or the rest plates 31, 32, in the illustrated example rest plate number 31, is provided with a depression 12 having a groove-shape; the depression 12 has a straight development and when the rest plate 31 is arranged on the base 2 the depression 12 is parallel to the blade 4.

The depression 12 of the extractable rest plate 31 has dimensions which are appropriate for containing a portion of a rotary cutting disc 14 (FIGS. 4, 6) of a tile, which rotary cutting disc 14 is positioned and acts, with respect to the base 2, such as to perform the cutting of the tile when the tile is resting on the rest surface 13.

The rotary cutting disc 14 is, for example, diamond-coated.

The blade 4 and the depression 12 are parallel and arranged at a certain distance from one another; to keep a measure of this, the base 2 also comprises a ruler 20, positionable transversally to the blade 4 and the depression 12, mobile along the axis thereof between at least two alignment positions of a relative reference (for example the reference "zero centimeters) with the blade 4 and the depression 12. In this way, the ruler 20 can be adjusted according to the type of use of the machine 1, for performing scoring and breaking operations or cutting operations, as will more fully emerge herein below.

FIGS. 4 to 7 relate to the cutting machine 1 of FIGS. 1-3, in which the lever 7 has been removed from the guide means 5 and an assembly 19 has been inserted thereof formed by a carriage 15 and by a group 16 comprising: an electric motor 17, the rotary cutting disc 14 drawn by the electric motor 17, and a handle 18 for facilitating displacement of the whole assembly 19.

The dimensions and conformation of the assembly 19, on the one side, and the position and dimension of the depression 12 on the other side are interconnected in such a way that the depression 12 can contain, as mentioned herein above, a portion of the rotary cutting disc 14 for the purpose of cutting a tile resting on the extractable rest plates 31, 32. In this way it is advantageously possible to mount the lever 7 on the guide means 5 in order to perform scoring and snapping operations, or the assembly 19 formed by the group 16 and the carriage 15 for cutting, for example, the harder tiles.

The tile-cutting machine 1 thus obtained enables cutting any type of tile, and exhibits a compact shape having a contained overall volume comparable to the volume of a conventional manual tile-cutting machine, thanks also to the possibility of demounting the assembly 19 from the guide means 5.

The above defines a method for adapting a conventional manual tile-cutting machine for use with the group 16 comprising the rotary cutting disc 14, including steps of:

demounting the lever 7 from the guide means 5;

mounting the carriage 15 on the guide means 5, which carriage 15 bears the group 16 comprising the rotary tile-cutting disc 14;

cutting the depression 12 in the rest surface 13 of the extractable plate, of such dimensions and positioned such as to contain a portion of the rotary cutting disc 14 when the group 16 is mounted on the carriage 15 and the carriage 15 runs on the guide means 5 of the tile-cutting machine 1 resting on the rest surface 13 of the extractable plates 31, 32.

The depression 12 can be made directly, using conventional tools, on the rest surface 13 of the extractable plate 31; alternatively the extractable plate 31 can be made separately (by press-forming) already provided with the depression 12, and then it can be substituted for the extractable rest plate of known type which is usual for manual tile-cutting machines and therefore does not afford the depression 12.

For this purpose, the invention further relates to a kit for adapting a conventional manual tile-cutting machine to use with the group 16 including the rotary cutting disc 14, comprising:

the group 16 comprising a rotary tile-cutting disc 14;

the carriage 15 on which the group 16 is mountable, which carriage 15 can run on the guide means 5;

at least an extractable rest plate 31 of the type described herein above, which comprises the depression 12 at the rest surface 13.

In accordance with the above, the lever 7 which slides along the guide means 5 acts as a first carriage, while the carriage 15 which bears the group 16 can be considered as a second carriage belonging to the machine 1.

The above-described machine 1 can be used as a tool if lacking the lever 7 and the group 16.

In a variant, not illustrated in the figures, the machine 1 is provided with one carriage only, on which the Scoring element 8 is mountable, as are the breaker feet 9 and the group 16. In this way, it would be advantageously possible to further reduce the dimensions.

With reference to the variant, a method is defined for adapting a conventional manual tile-cutting machine to use with the group 16 comprising the rotary cutting disc 14, comprising steps of:

demounting the lever 7 from the guide means 5; mounting the carriage on the guide means 5;

mounting the scoring element 8 and the breaker feet 9 and/or the group 16 comprising the rotary tile-cutting disc 14 on the carriage;

cutting the depression 12 in the in the rest surface 13 of the extractable plate 31, of such dimensions and positioned such as to contain a portion of the rotary cutting disc 14 when the group 16 is mounted on the carriage and the carriage runs on the guide means 5 in the tile-cutting machine resting on the rest surface 13 of the extractable plates 31, 32.

The carriage can contemporaneously bear the scoring element 8, the breaker feet 9 and the group 16.

Still with reference to the variant, the invention relates to a kit for adapting a conventional manual tile-cutting machine for use with the group 16 including the rotary cutting disc 14, comprising:

the group 16 comprising the rotary tile-cutting disc 14, comprising; and the carriage on which the scoring element 8, the breaker feet 9 and the group 16, which carriage can run on the guide means 5;

at least an extractable rest plate 31 of the above-described type, which is provided with the depression 12 at the relative rest surface 13. For example, the carriage also bears a handle for facilitating displacement thereof.

In the variant, even if not provided with the scoring element 8, the breaker feet 9 and the group 16, the above-described machine 1 can still be referred to as equipment.

The assembly 19 can additionally comprise a source of depression, not shown in the figures, activated by an external supply source or by the electric motor 17, for aspirating the powder produced during the cutting of the tile by the diamond cutting disc 14. As an alternative to the use of the source of depression, the cutting machine can comprise: a slit, not indicated, to replace the depression, having a position and dimensions according to what was described herein above with reference to the depression 12; a collecting tray (not illustrated) arranged below the base 2 and communicating with the slit; and means, also not indicated, for injecting a liquid onto the diamond cutting disc 14 during the cutting, with the aim of conveying the powder into the collecting tray. A liquid source can also be provided, for example an additional liquid tank, and a pump cooperating with the injection means of the liquid for collecting the liquid to be injected in the cutting zone of the collecting tray and from the additional source.

Instead of the slit 12, the depression 12 can be provided with an opening at an end communicating with the collecting tray.

The machine 1 can also be provided with one or more additional modules, not illustrated, having the same width as the base 2 and a predetermined length; the modules are removably fixed between an end of the base 2 and a head 6 for increasing an overall length of the machine 1. This advantageously enables the machine 1 to be adapted according to the dimensions of the tiles to be cut.

The above is intended to be a non-limiting description by way of example, and any constructional variants are considered to fall within the ambit of protection of the present technical solution, as claimed herein below.

The invention claimed is:

1. A base (2) for supporting tiles to be cut, comprising:

a surface (13) for restingly receiving a tile;

and a blade (4) for encountering a lower surface of the tile during a stage of scoring the tile;

wherein the rest surface (13) is provided with a depression or slit (12) of such dimensions as to contain a portion of a rotary cutting disc (14) of the tile when the tile is resting on the rest surface (13).

2. The base (2) of claim 1, wherein the rest surface (13) is part of an extractable rest plate (31) of the base (2).

3. The base (2) of claim 1, wherein the depression or slit (12) develops parallel to the blade (4).

4. The base (2) of claim 1, wherein the depression (12) is shaped as a channel.

5. The base (2) of claim 1, comprising a ruler (20) that can be positioned transversally to the blade (4) and to the depression or slit (12) and which is mobile along an axis thereof between at least two alignment positions of a relative reference with the blade (4) and the depression or slit (12).

6. Equipment for cutting tiles, comprising:

a base (2) according to claim 1;

a guide (5) arranged above the base (2);

a lever (7) which can slide on the guide (5) on which lever (7) a tile scoring element (8) is mounted.

7. The equipment for cutting tiles of claim 6 further comprising:

a carriage (15) which can slide on the guide (5), on which carriage (15) a group (16) comprising a rotary cutting disc (14) of the tile is mountable.

8. A machine (1) for cutting tiles, comprising:

equipment as in claim 6;

the tile scoring element (8);

and a group (16) comprising a rotary cutting disc (14) of the tile;

the depression or slit (12) of the rest surface (13) being positioned with respect to an assembly (19) formed by the group (16) and the carriage, and the assembly (19) being of such dimensions that the depression or slit (12) contains a portion of the rotary cutting disc (14) when the group (16) is mounted on the carriage and the carriage slides on the guide (5) of the machine (1) in order to cut a tile resting on the base (2).

9. A machine (1) for cutting tiles, comprising:

equipment as in claim 7;

the tile scoring element (8);

and the group (16) comprising the rotary cutting disc (14) of the tile; the depression or slit (12) of the rest surface (13) being positioned with respect to the assembly (19) formed by the group (16) and by the carriage, and the assembly (19) being of such dimensions that the depression or slit (12) contains a portion of the rotary cutting disc (14) when the group (16) is mounted on the second carriage (15) and the carriage (15) slides on the guide (5) of the machine (1) for cutting a tile resting on the base (2).

10. The machine (1) of claim 8, further comprising:

two heads (6) that are fixable respectively to the ends of the base (2), which heads (6) support the guide (5);

and at least an additional module, which additional module is fixable between an end of the base (2) and a head (6) for increasing an overall length of the cutting machine (1).

11. A kit for adapting a manual tile-cutting machine (1) for use with a group (16) comprising a rotary tile-cutting disc (14), the manual tile-cutting machine (1) comprising:

a base (2) comprising a first extractable rest plate which in turn comprises a surface for restingly receiving a tile; and a blade (4) for contacting the lower surface of the tile during a scoring stage thereof;

a guide (5) arranged above the base (2);

wherein the kit comprises:

a group (16) comprising a rotary tile-cutting disc (14);

a carriage (15) on which the group (16) is mountable, which carriage (15) can run on the guide (5);

a second extractable rest plate (31) which comprises a surface (13) for restingly receiving a tile, which rest surface (13) is provided with a depression or slit (12) of such dimensions and so positioned in order to contain a portion of the rotary cutting disc (14) when the group (16) is mounted on the carriage (15) and the carriage (15) slides on the guide (5) of the machine (1) in order to cut a tile resting on the base (2).

12. A kit for adapting a manual tile-cutting machine (1) for use with a group (16) comprising a rotary tile-cutting disc (14), the manual tile-cutting machine (1) comprising:

a base (2) comprising a first extractable rest plate which in turn comprises a surface for restingly receiving a tile; and a blade (4) for contacting the lower surface of the tile during a scoring stage thereof;

a guide (5) arranged above the base (2);

wherein the kit comprises:

a group (16) comprising a rotary tile-cutting disc (14);

a carriage (15) on which the group (16) is mountable, and on which a tile-scoring element (8) is mountable, which carriage (15) can run on the guide (5);

a second extractable rest plate (31) which comprises a surface (13) for restingly receiving a tile, which rest surface (13) is provided with a depression or slit (12) of such dimensions and so positioned in order to contain a portion of the rotary tile-cutting disc (14) when the group (16) is mounted on the carriage (15) and the carriage (15) slides on the guide (5) of the machine (1) in order to cut a tile resting on the base (2).

13. A method for adapting a manual tile-cutting machine (1) for use with a group (16) comprising a rotary tile-cutting disc (14), the manual tile-cutting machine comprising:

a base (2) for supporting tiles to be cut, comprising a surface (13) for restingly receiving a tile; and a blade (4) for encountering a lower surface of the tile during the stage of scoring the tile;

a guide (5) arranged above the base (2);

a carriage which can slide on the guide (5), on which carriage a tile-scoring element (8) is mounted;

wherein the method comprises stages of:

adapting the carriage such that a group (16) is further mountable thereon, the group (16) comprising a rotary tile-cutting disc (14);

providing a depression or slit (12) in the rest surface (13) of the extractable rest plate, which is of such dimensions and is positioned such as to contain a portion of the rotary cutting disc (5) of the tile-cutting machine (1) when the group (16) is mounted on the carriage and the carriage slides on the guide (5) of the tile-cutting machine (1) resting on the rest surface (13) of the extractable rest plate (31).

14. A method for adapting a manual tile-cutting machine (1) for use with a group (16) comprising a rotary tile-cutting disc (14), the tile-cutting machine (1) comprising:

a base (2) for supporting tiles to be cut, comprising s surface (13) for restingly receiving a tile; and a blade (4) for encountering a lower surface of the tile during the stage of scoring the tile;

a guide (5) arranged above the base (2);

wherein the method comprises stages of:

providing a carriage (15) which bears a group (16) comprising a rotary tile-cutting disc (14), which carriage (15) can slide on the guide (5);

providing a depression or slit (12) in the rest surface (13) of the extractable plate (14), of such dimensions and so positioned to contain a portion of the rotary cutting disc (14) when the group (16) is mounted on the carriage (15) and the carriage (15) slides on the guide (5) of the machine (1) for cutting a tile resting on the rest surface (13) of the extractable rest plate (31).

15. The machine (1) of claim 9, further comprising:

two heads (6) that are fixable respectively to the ends of the base (2), which heads (6) support the guide (5);

and at least an additional module, which additional module is fixable between an end of the base (2) and a head (6) for increasing an overall length of the cutting machine (1).

* * * * *